US007143694B2

(12) United States Patent
Schuster et al.

(10) Patent No.: US 7,143,694 B2
(45) Date of Patent: Dec. 5, 2006

(54) METHOD AND APPARATUS FOR CLEANING AND ERASING PRINTING SURFACES, IN PARTICULAR PRINTING SURFACES OF FORME AND BLANKET CYLINDERS IN A PRINTING MACHINE

(75) Inventors: Alfons Schuster, Augsburg (DE); Michael Schönert, Augsburg (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 0 days.

(21) Appl. No.: 10/278,159

(22) Filed: Oct. 22, 2002

(65) Prior Publication Data

US 2003/0084804 A1 May 8, 2003

(30) Foreign Application Priority Data

Nov. 6, 2001 (DE) ..... 101 54 430

(51) Int. Cl.
*B41F 33/00* (2006.01)

(52) U.S. Cl. ..... 101/483; 101/424

(58) Field of Classification Search ..... 101/423–425, 101/483, 484; 15/256.5, 256.51, 256.52, 15/256

See application file for complete search history.

(56) References Cited

U.S. PATENT DOCUMENTS 4,967,664 A * 11/1990 Iijima ..... 101/423
5,069,124 A * 12/1991 Schneider ..... 101/142
5,964,157 A 10/1999 Hummel et al. ..... 101/483
6,006,666 A * 12/1999 Gottling ..... 101/425
6,016,750 A * 1/2000 Nussel et al. ..... 101/463.1
6,082,263 A * 7/2000 Koguchi et al. ..... 101/456
6,109,182 A * 8/2000 Vestman et al. ..... 101/483
6,408,755 B1 * 6/2002 Meisters et al. ..... 101/478
6,588,337 B1 * 7/2003 Kreckel et al. ..... 101/424
6,701,842 B1 * 3/2004 Hartmann et al. ..... 101/467
6,928,930 B1 * 8/2005 Gottling et al. ..... 101/424

FOREIGN PATENT DOCUMENTS

DE 44 26 012 C2 1/1996
DE 196 03 455 8/1997
DE 199 63 124 7/2001

* cited by examiner

*Primary Examiner*—Anthony H. Nguyen
(74) *Attorney, Agent, or Firm*—Cohen, Pontani, Lieberman & Pavane

(57) ABSTRACT

The amount of cleaning media needed for cleaning the printing forme is determined with regard to the level of coverage with ink and/or image carrier material of a printing surface and/or from image data about the printing surface. An erasing and hydrophilizing apparatus includes a cleaning apparatus and nozzles for applying a cleaning medium, the cleaning apparatus and/or the nozzles being connected to a computing and/or storage device.

12 Claims, 2 Drawing Sheets

METHOD AND APPARATUS FOR CLEANING AND ERASING PRINTING SURFACES, IN PARTICULAR PRINTING SURFACES OF FORME AND BLANKET CYLINDERS IN A PRINTING MACHINE

BACKGROUND OF THE INVENTION

1. Field of the Invention

The invention relates to a method for cleaning and erasing printing surfaces, in particular printing surfaces of forme and blanket cylinders in a printing machine, wherein cleaning media is applied either directly or indirectly to the surface of the printing forme.

2. Description of the Related Art

DE 44 26 012 A1, which corresponds to U.S. Pat. No. 6,016,750, discloses a method of erasing a printing forme which can have an image set and can be erased directly. Following the printing operation, there may be both ink and image carrier materials representing the printing image on such a printing surface. These have to be removed. This is done by means of suitable cleaning media and a suitable cleaning apparatus. A cleaning apparatus of this type is described in the application DE 44 26 012 A1.

The disadvantage of the apparatus and of the method described in DE 44 26 012 A1 is that the cleaning and the erasing is always designed for a printing surface which has a maximum area coverage—100% area coverage—with ink and image carrier material. As a rule, this does not occur, normally the area coverages are considerably lower, so that as a rule too much material and time is used in the cleaning and erasing.

SUMMARY OF THE INVENTION

It is the object of the invention to provide a method for cleaning and for erasing a printing surface, optimization of the cleaning operation with regard to a reduction in the time and material required being possible.

According to the invention, the object is achieved by determining the amount of cleaning media needed for cleaning the printing surface based on at least one of the level of area coverage with ink, the level of area coverage with image carrier material, and image data about the printing surface.

The advantage of the invention is that an optimized speed and an optimized media consumption can be achieved in the cleaning and/or erasing operation.

The invention also relates to an apparatus for cleaning and for erasing printing surfaces, in particular printing surfaces of forme and blanket cylinders in a printing machine, which takes into account the actual area coverage of the printing surface with ink and/or image carrier material.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PRESENTLY PREFERRED EMBODIMENTS

Figure 1:
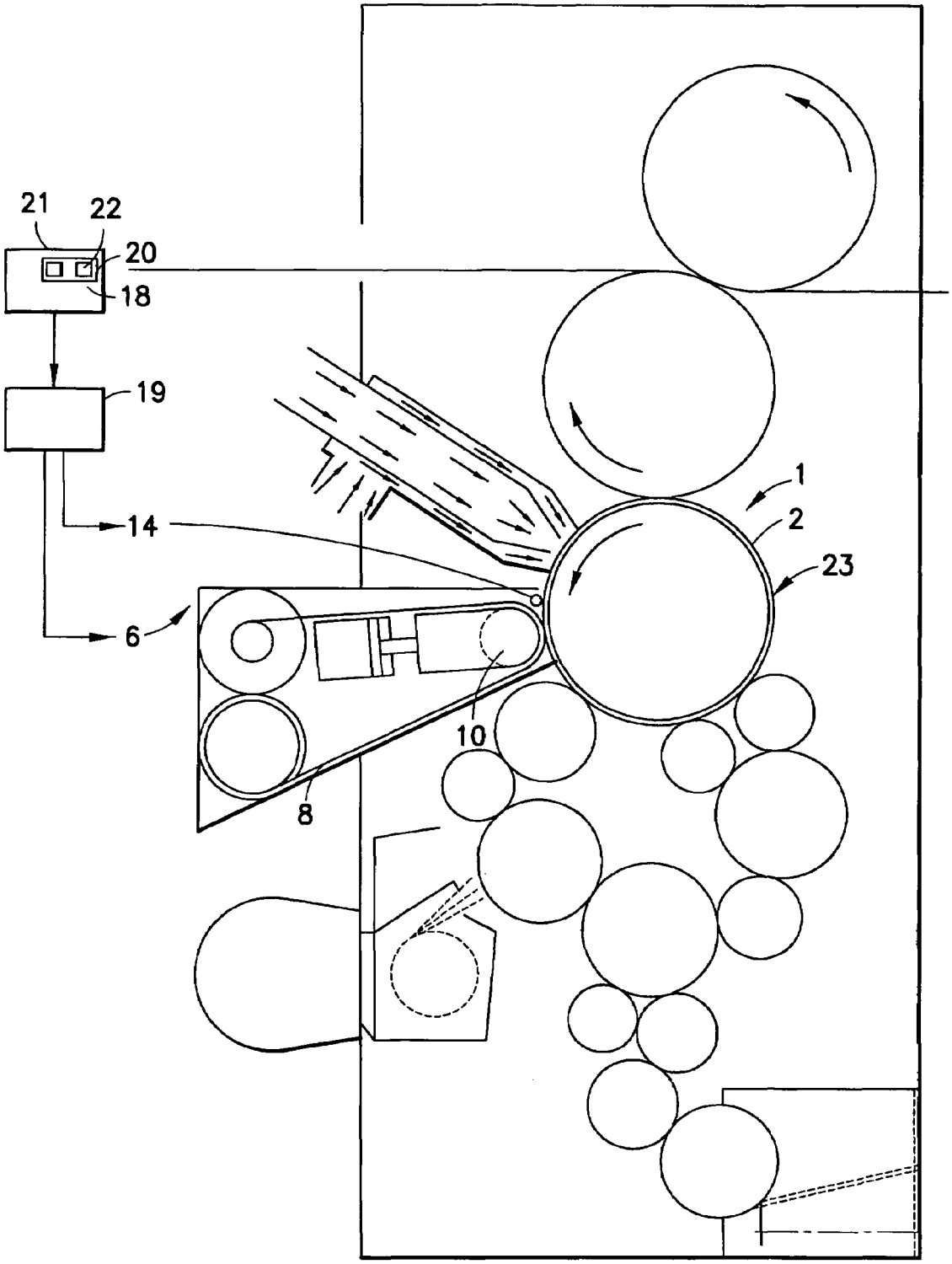
FIG. 1 is a schematic end view of the apparatus according to the invention for cleaning and erasing printing surfaces.

FIG. 1 shows a printing unit in an offset printing machine, having a cleaning apparatus 6 for cleaning and for erasing printing surfaces 23 of a printing forme 2 of a forme cylinder 1.

These elements and the further construction, in particular of the cleaning apparatus 6, are illustrated in FIG. 1 in the present application, but are described in the application DE 44 26 012 C2, which corresponds to U.S. Pat. No. 6,016,750, which is incorporated herein by reference.

The apparatus according to the invention for cleaning and for erasing printing surfaces 23 is, as an addition to the cleaning apparatus 6 disclosed by the above-mentioned application, connected to a computing and/or storage device 19, it also being possible for the computing and/or storage device 19 to be connected directly to the nozzles 14 disclosed by the above-mentioned application and/or to conveying and storage means for the cleaning media. The computing and/or storage device 19 is connected to a computing and/or storage device 18 in the prepress stage. Alternatively, the computing and/or storage device 19 can be integrated in the computing and/or storage device 18.

The prepress stage is ideally a digital prepress stage, which contains and manages all the data relating to the text prepress stage, the image prepress stage and the prepress stage for the production of the printing forme, as used for example in a printing machine with digital printing forme production—for example in the case of computer-to-press.

The computing and/or storage device 18 can also be connected (not specifically illustrated) to a computer for the inking zone setting, to the control desk of the printing machine and/or to other computing and storage devices in the printing machine or can be integrated in these devices.

The respective above-mentioned computing and storage devices contain and process image data 20, for example exposure data 21 or data 22 relating to the quantity of printing ink to be applied, it being possible for these data for example (not specifically illustrated) to be tapped off from the position of the ink slides of the ink zone setting or from the prepress stage. The image data 20, exposure data 21 and/or data 22 about the quantity of printing ink to be applied are made available to the computing and/or storage device 18 and/or transmitted to this computing and/or storage device 18.

From these image data 20, in particular the exposure data 21, the computing and/or storage device 19 is able to determine the level of coverage of a printing surface 23 and therefore to determine both the requirement for erasing and/or cleaning medium and the number of cleaning steps and/or the chronological sequence and duration of the cleaning steps.

Figure 2:
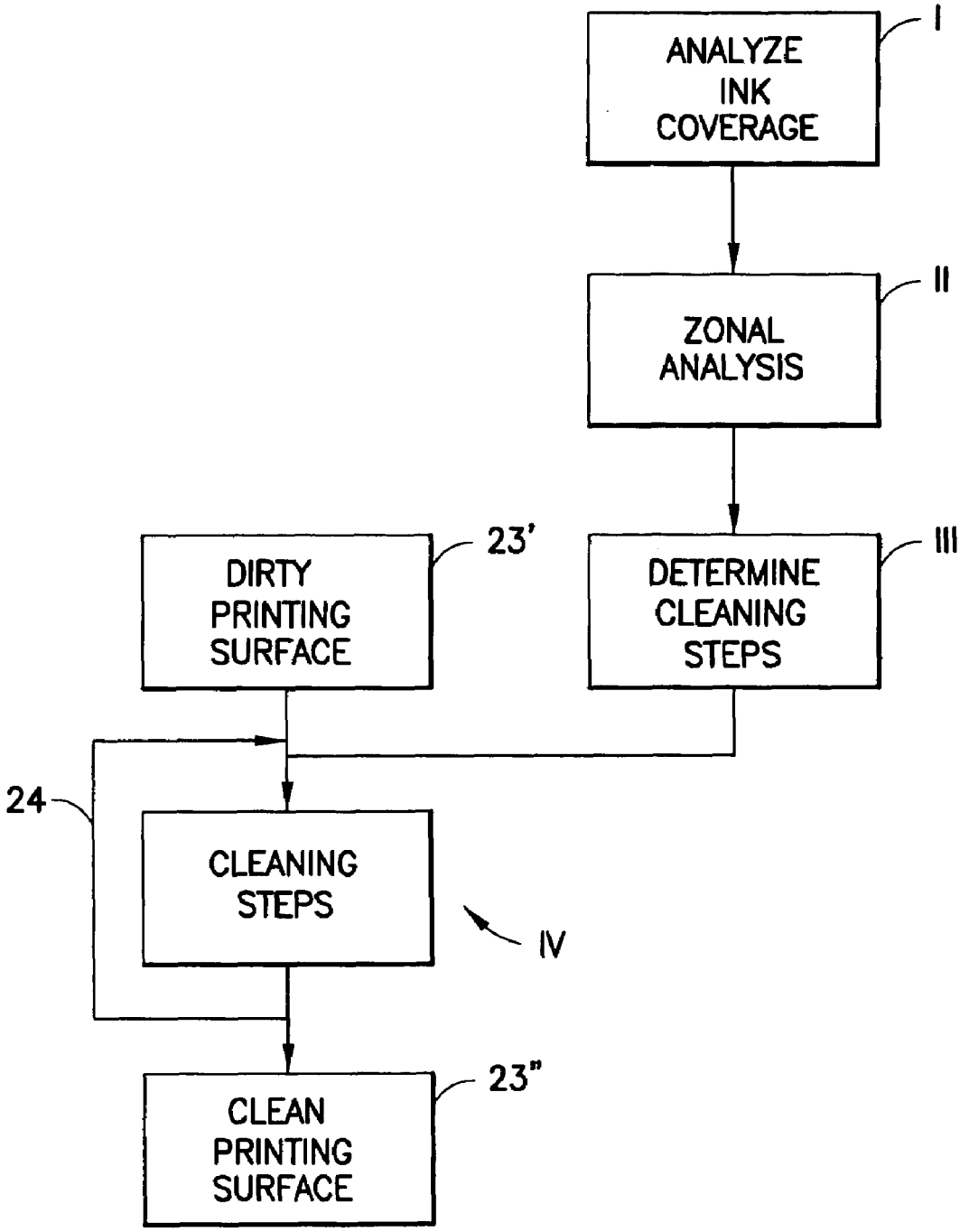
FIG. 2 is a schematic diagram of the method sequence according to the invention for cleaning and erasing printing surfaces.

FIG. 2 shows the method sequence for cleaning and for erasing printing surfaces 23 schematically in a diagram.

The cleaning is composed of a sequential sequence of cleaning steps in which the cleaning media are applied to the soiled printing surface 23' of the printing forme 2 or to the cleaning cloth 8.

First of all, the ink, if present, is removed and then the image carrier materials representing the printing image. Alternatively, further intermediate steps can be carried out between these steps, using another liquid, for example water.

The sequence of cleaning steps or parts thereof are if necessary carried out once or repeatedly in repetitions 24, until the printing forme 2 or the printing surface 23 of the printing form 2 has been cleaned completely. The repetitions 24 of the sequence of cleaning steps or parts thereof are carried out either with a constant amount of cleaning media, or the amount of cleaning media decreases step by step. The cleaning steps and the repetitions 24 of the cleaning steps constitute the fourth step IV of the method for cleaning and for erasing printing surfaces 23. Following the cleaning or erasing of the soiled printing surface 23', a clean printing surface 23" is obtained.

Before the actual cleaning or erasing of the printing surface 23 (step IV), the printing forme 2 is analysed with regard to its level of area coverage or level of coverage with ink and/or image carrier material in a first step I using the image data 20 and, by using the area coverage which actually occurs, the amount of cleaning medium and/or cleaning media or the number of cleaning steps and/or the chronological sequence and duration of the cleaning steps are determined in a third step III.

The data 20, by means of which the level of coverage with ink and/or image carrier material may be determined, can be tapped off, as already explained above, from the position of the ink slides of the ink zone setting or from the prepress stage.

A cleaning medium that can be used specifically for the cleaning or for the erasing of erasable printing formes 2 is described in U.S. Pat. No. 6,525,008.

In order to analyse the level of coverage of the printing forme 2 with ink and/or image carrier material, the printing forme 2 is subdivided into zones in the circumferential direction. These zones are respectively analysed separately in a zonal analysis. This zonal analysis constitutes the second step II of the method. The zone with the highest level of area coverage or level of coverage determines the overall amount of cleaning medium for ink and/or image carrier material which is needed. The zone with the highest level of area coverage or level of coverage also determines the number of cleaning steps and/or the chronological sequence and duration of the cleaning steps. The zones are typically 1 mm wide. The data for this purpose are preferably obtained from the image data 20 about the printing forme 2, for example from the exposure data 21 for the printing forme 2. Alternatively, the printing forme 2 can be analysed by a suitable apparatus which, for example, can be arranged inside or outside the printing unit.

In addition, boundary parameters such as the type and amount of the image-setting material, and specific machine states, such as the printing machine having made an emergency stop (safety stop), or the number of printing operations can be included in the zonal analysis in the second step II, and therefore in the calculation (step III).

For the case in which the data about the zonal coverage or area coverage are not available or incompletely available, an operating mode is provided which is able to clean a printing forme 2 with maximum coverage, irrespective of the subject.

The method explained above can also be used to optimize the rubber blanket washing. In this case, the printed edition can be used in a suitable way as a further parameter for determining the amount of media.

Furthermore, the method can be applied both in and outside a printing machine.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

We claim:

1. A method of cleaning and erasing a printing image on a printing surface of a printing forme, the printing image being defined by an image carrier material arranged on the printing surface of the printing forme, said method comprising determining the amount of cleaning media needed for removing the image carrier material from the printing surface of the printing forme based on image data about the printing surface, wherein said image data comprise at least one of exposure data and data about the amount of printing ink to be supplied, applying said amount of cleaning media to said printing surface, and erasing the printing image by removing the image carrier material from the printing surface.

2. A method as in claim 1 further comprising calculating the number of individual cleaning steps and the duration of individual cleaning steps.

3. A method according to claim 1 further comprising taking said image data from one of a prepress stage, an inking zone setting, and a control desk of the printing machine.

4. A method according to claim 1 further comprising providing said image data, analyzing individual zones of said printing surface to determine the zone with the highest level of ink coverage, and calculating at least one of the amount of cleaning media and the number, chronological sequence and duration of cleaning steps based on the zone having the highest level of ink coverage.

5. A method as in claim 1 further comprising removing ink from the printing surface, whereby further intermediate steps can be carried out with other cleaning media.

6. A method as in claim 1 wherein the amount of cleaning media is determined based on the level of area coverage with ink.

7. A method as in claim 1 wherein the amount of cleaning media needed for erasing the printing image is also based on the level of area coverage with image carrier material.

8. An apparatus for cleaning and erasing a printing image on a printing surface of a printing forme, the printing image being defined by an image carrier material arranged on said printing surface of said printing forme, said apparatus comprising nozzles for applying cleaning media to said surface, a cleaning apparatus for erasing and hydrophilizing said surface, and a first computing and storage device connected to at least one of said nozzles and said cleaning apparatus, said first computing and storage device determining the amount of cleaning media needed for removing the image carrier material from said surface based on image data about the printing surface, wherein said image data comprise at least one of exposure data and data about the amount of printing ink to be supplied, wherein said nozzles and said cleaning apparatus are arranged and dimensioned for applying cleaning media and erasing the printing image by removing the image carrier material from said surface in response to said first computing and storage device.

9. An apparatus as in claim 8 wherein said first computing and storage device belongs to one of a prepress stage, a control desk of the printing machine, and a computer for inking zone settings.

10. An apparatus as in claim 8 wherein said computing and storage device contains image data from the printing surfaces of individual printing formes.

11. An apparatus as in claim 8 further comprising a second computing and storage device arranged between said first computing and storage device and said at least one of said nozzles and said cleaning apparatus.

12. An apparatus as in claim 8 wherein the first computing and storage device also determines the amount of cleaning media needed for erasing the printing image based on the level of area coverage with image carrier material.

* * * * *